US011097866B2

(12) United States Patent
Styskin et al.

(10) Patent No.: US 11,097,866 B2
(45) Date of Patent: Aug. 24, 2021

(54) PLASTIC BOTTLE

(71) Applicant: GSGRUPP LLC, Moscow (RU)

(72) Inventors: Mark Mikhailovich Styskin, Moscow (RU); Konstantin Mikhailovich Golenkov, Moscow (RU)

(73) Assignee: GSGRUPP LLC, Moscow (RU)

( * ) Notice: Subject to any disclaimer, the term of this patent is extended or adjusted under 35 U.S.C. 154(b) by 0 days.

(21) Appl. No.: 16/318,147

(22) PCT Filed: Jul. 12, 2017

(86) PCT No.: PCT/RU2017/000518
§ 371 (c)(1),
(2) Date: Jan. 16, 2019

(87) PCT Pub. No.: WO2018/016992
PCT Pub. Date: Jan. 25, 2018

(65) Prior Publication Data

US 2019/0233155 A1 Aug. 1, 2019
US 2020/0247572 A9 Aug. 6, 2020

(30) Foreign Application Priority Data

Jul. 19, 2016 (RU) ..... RU2016129337

(51) Int. Cl.
*A45F 3/16* (2006.01)
*B65D 23/00* (2006.01)
(Continued)

(52) U.S. Cl.
CPC ..... *B65D 1/40* (2013.01); *B65D 1/0223* (2013.01); *A45F 5/02* (2013.01); *B65D 23/003* (2013.01)

(58) Field of Classification Search
CPC .... A45F 3/18; A45F 5/02; A45F 5/021; A45F 2200/0583; B65D 1/40; B65D 1/0223; B65D 23/102; B65D 23/003
(Continued)

(56) References Cited

U.S. PATENT DOCUMENTS 3,920,140 A * 11/1975 Kiser ..... B62J 11/00 215/399
D253,871 S * 1/1980 Hartung ..... D9/520
(Continued)

FOREIGN PATENT DOCUMENTS

DE 20010328 U1 9/2000
WO WO 2007/098528 A1 9/2007

OTHER PUBLICATIONS

International Search Report, International patent application No. PCT/RU2017/000518, dated Nov. 7, 2017.

*Primary Examiner* — Gideon R Weinerth
(74) *Attorney, Agent, or Firm* — Da Vinci Partners LLC; John Moetteli

(57) ABSTRACT

The invention relates to the storage and transportation of liquid products, and specifically to a plastic bottle. The challenge which this invention is designed to address is to increase the performance characteristics of a bottle, i.e. to create a lightweight design of bottle which is easy to manufacture and enables said bottle to be securely attached to items of clothing etc. The challenge in question is addressed by the fact that the plastic bottle, comprising a hollow thin-walled body ending with a neck, and a holder which is designed in the form of an open groove, molded in the body, parallel to the central axis of the bottle and extending for more than half the height of the bottle, is characterized by the fact that the projections of the walls of the groove on the plane, which is perpendicular to the transverse axis of the groove, are in the form of zigzag-
(Continued)

Figure 1:
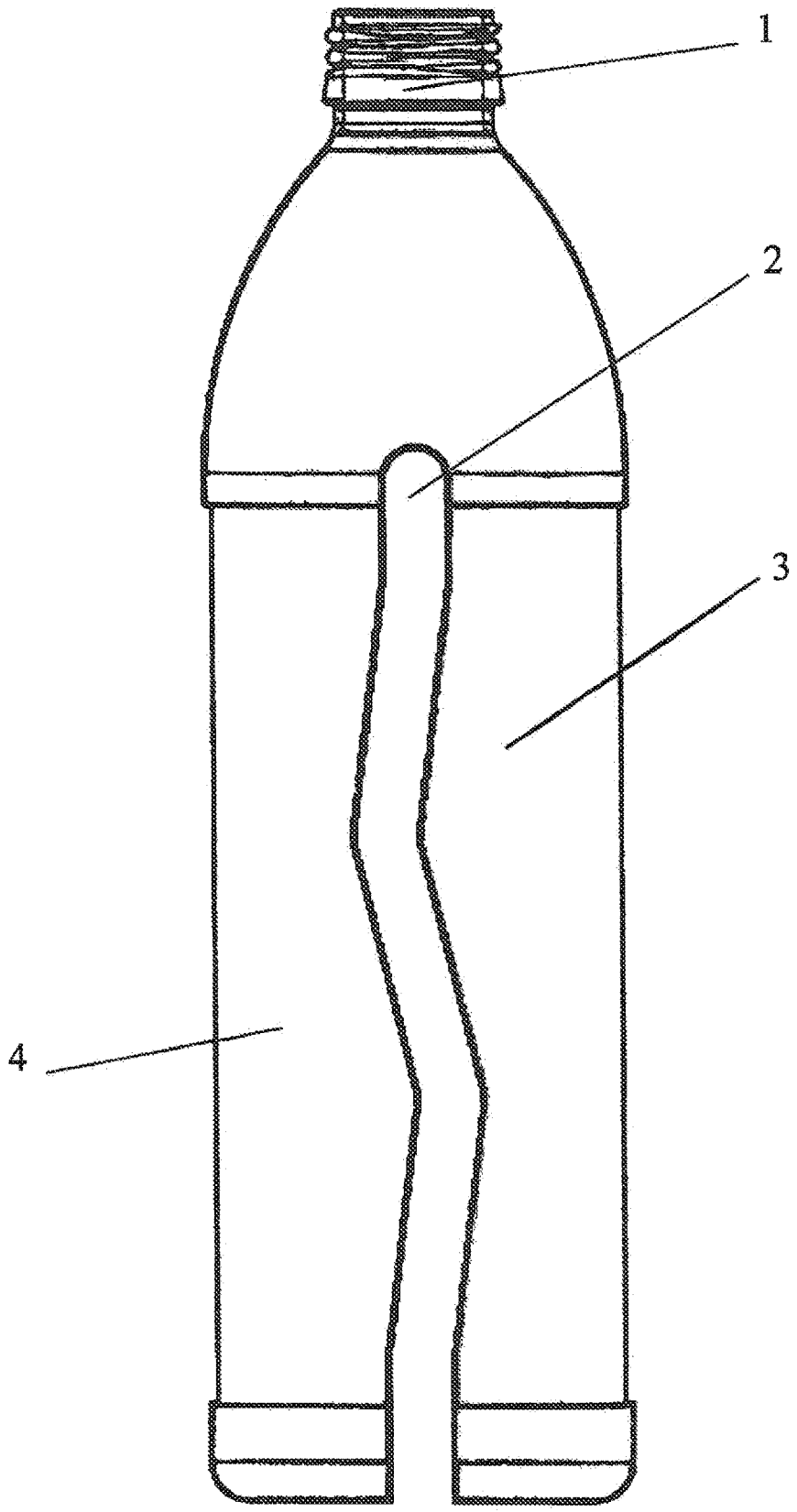

shaped lines. Furthermore, each zigzag-shaped line may consist of sections of straight lines and/or sections of curved lines.

6 Claims, 7 Drawing Sheets

(51) Int. Cl.
*B65D 1/02* (2006.01)
*B65D 1/40* (2006.01)
*A45F 5/02* (2006.01)

(58) Field of Classification Search
USPC ..... D9/530, 543, 520, 521, 522, 571, 569; 220/475; 222/181.1, 212, 494; 224/148.4, 148.1; 248/312
See application file for complete search history.

(56) References Cited

U.S. PATENT DOCUMENTS

D254,235 S * 2/1980 Hartung ..... D9/520
D254,597 S * 4/1980 Hartung ..... D9/520
D281,302 S * 11/1985 Hartung ..... D9/520
5,114,061 A * 5/1992 Brady ..... A45C 11/22 224/194
D357,542 S * 4/1995 Vaichis ..... D24/197
5,419,447 A * 5/1995 Lim ..... A61J 9/00 215/11.1
6,019,335 A * 2/2000 Sehati ..... A45F 5/02 224/148.4
D430,492 S * 9/2000 Dallas, Jr. ..... D9/520
6,179,166 B1 * 1/2001 Dallas, Jr. ..... A47K 5/1214 220/475
6,273,283 B1 * 8/2001 Terrana ..... A45F 3/16 215/383
D519,032 S * 4/2006 Abadinsky ..... D9/522
8,146,760 B1 * 4/2012 Leach ..... A61J 9/00 215/11.1
D684,479 S * 6/2013 Vella ..... D9/520
D740,685 S * 10/2015 Hamilton ..... D9/522
D745,405 S * 12/2015 Inzani ..... D9/543
2005/0133538 A1 * 6/2005 Herrmann ..... B65D 1/0223 222/192
2009/0095703 A1 * 4/2009 Keeler ..... B65D 23/102 215/398
2012/0318832 A1 * 12/2012 Hock ..... A45F 5/021 224/148.1
2014/0027477 A1 * 1/2014 deBeers ..... A45F 5/02 224/148.4
2020/0060412 A1 * 2/2020 Maxwell ..... B65D 23/102

* cited by examiner

PLASTIC BOTTLE

TECHNICAL FIELD

The invention relates to the storage and transportation of liquid, mostly food products, and specifically to a plastic bottle, which can be used for industrial bottling, subsequent transportation of various beverages and selling the same to consumer.

PRIOR ART

Using semi-rigid plastic bottles of polyethylene terephthalate for bottling various beverages is widespread today. The bottles are generally sealed with screw caps.

Plastic bottles for retail sale of beverages are mostly made with a capacity of 0.3 liter to 3.0 liters. Bottles of a smaller volume (0.3 to 0.6 l) are filled with beverages to be consumed by a single person, in particular, over a short period of time, outside a specially equipped eating area, during a walk, while in transport, etc.

Plastic bottles generally have no means for holding them in hands. A bottle may be held either by the body of the bottle, or by a radial protrusion at the neck of the bottle. Therefore, a plastic bottle of a known design, especially when filled with water, is not convenient for being carried in hands for a long time. A bag has to be used to carry such bottle.

At the same time, for the case, where liquid food products are bottled in a volume of 0.3 to 0.6 l, it is preferable to use containers that would enable to completely avoid carrying in hands, which is relevant for walking, sports training, or simply to keep the hands free, etc.

This problem is solved in a plastic bottle containing a holder (see U.S. Pat. No. 6,019,335 A, Jan. 2, 2000).

This holder has a disadvantage lying in the fact that it has to be manufactured separately and mounted on the bottle, which would result in either a rise in the cost of the bottle, or in the necessity to keep such holder to hand all the time.

Bottles are also known, which end with a hollow thin-walled body with a bracket made integral therewith (see, e.g., utility model patent RU 96556 U, Oct. 8, 2010 or application WO01/72594, 2001).

Among the disadvantages of these bottles is the complexity of their manufacture, as well as the fact that the entire weight of the liquid is beyond the clothes, which results in high loads on both the bracket and the item of clothing.

The closest in terms of technical essence and the result achieved is a container for beverages having a means for attachment to the user's clothes (see WO 2007/098528 A1, 2007).

The container is a plastic bottle comprising a hollow thin-walled body ending with a neck, and a holder which is designed in the form of an open groove, molded in the body, parallel to the central axis of the bottle and extending for more than half the height of the bottle.

The disadvantages of the known container include poor reliability of attachment of the container to the item of clothing due to a low factor of friction between the means of attachment and the item of clothing.

Essence of Invention

The challenge which this invention is designed to address is to increase the performance characteristics of a bottle, i.e. to create a lightweight design of bottle which is easy to manufacture and enables said bottle to be securely attached to items of clothing etc.

The technical result of the invention is higher reliability of attachment of the bottle to items of clothing, bags, in vehicles owing to increased friction between the bottle and the object, to which it is attached.

The above technical result is achieved by the fact that a plastic bottle comprising a hollow thin-walled body ending with a neck, and a holder which is designed in the form of an open groove, molded in the body, parallel to the central axis of the bottle and extending for more than half the height of the bottle, is characterized by the fact that the projections of the walls of the groove on the plane, which is perpendicular to the transverse axis of the groove, are in the form of zigzag-shaped lines, where each zigzag-shaped line may consist of sections of straight lines and/or sections of curved lines.

With the above configuration of the groove walls, the area of contact between the bottle and the object of attachment is increased, and the material, to which the bottle is attached, is bent, which enables to increase the friction factor. The reliability of attachment is increased along with the friction factor.

LIST OF FIGURES AND DRAWINGS

Figure 2:
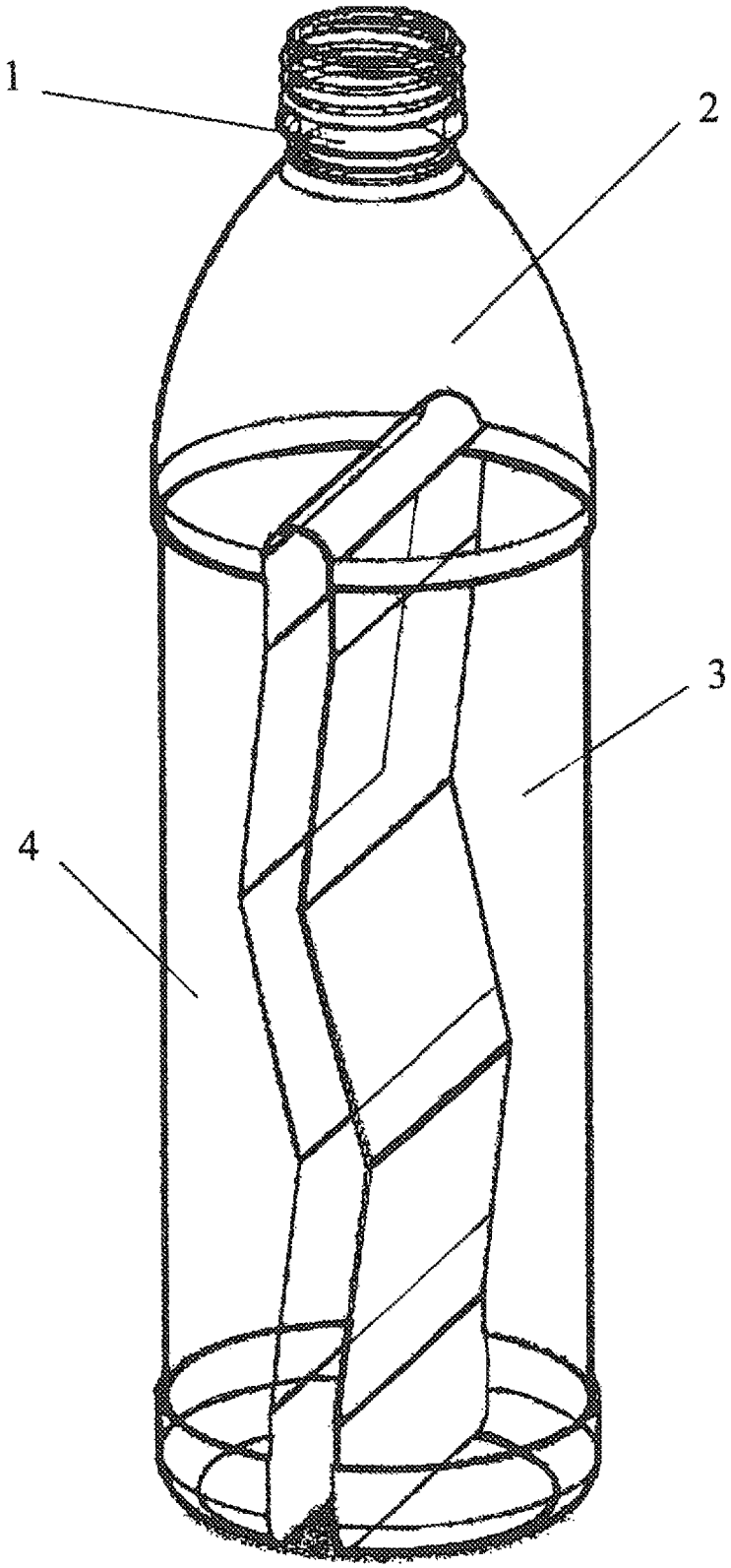
Figure 3:
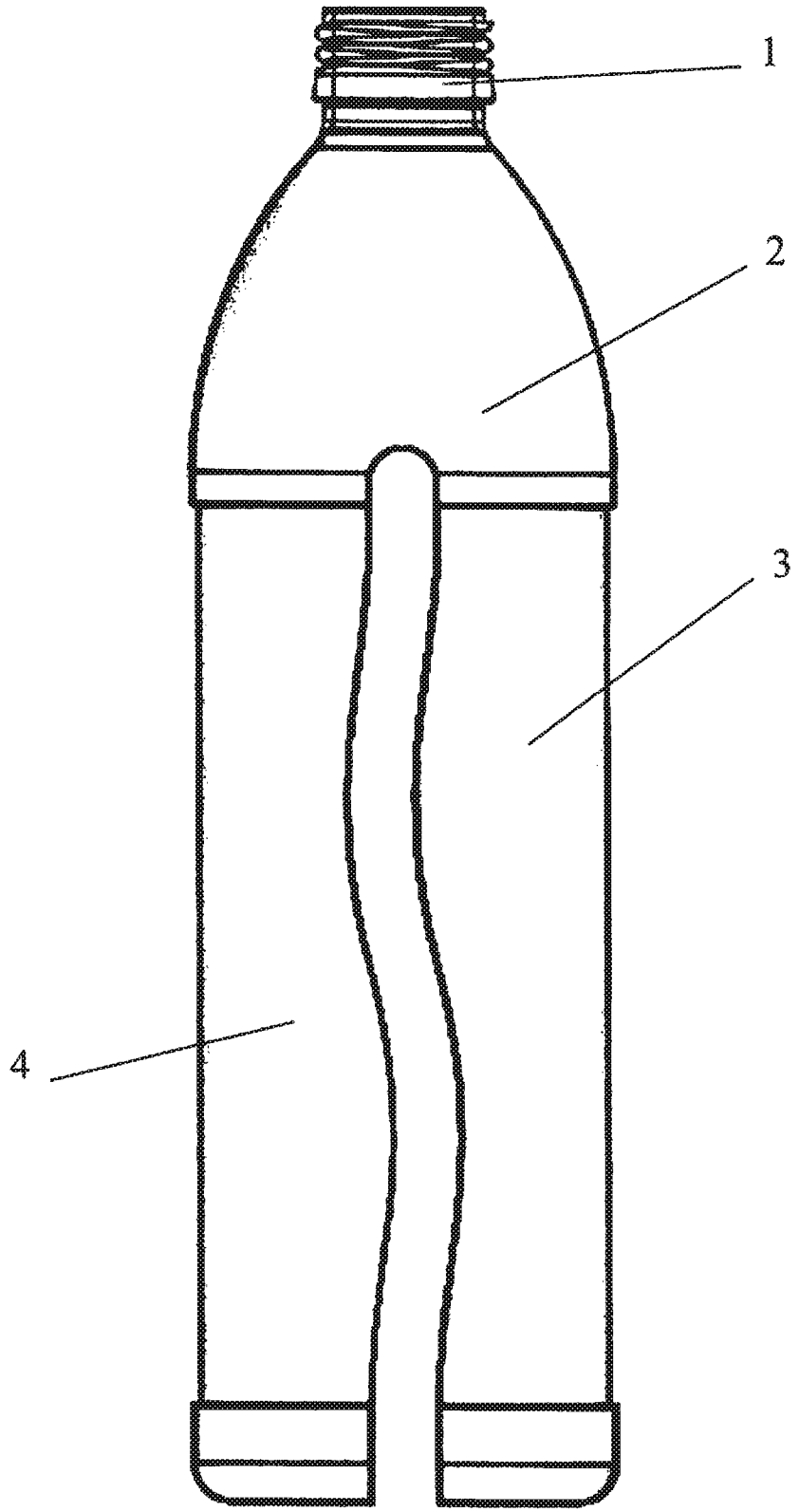
Figure 4:
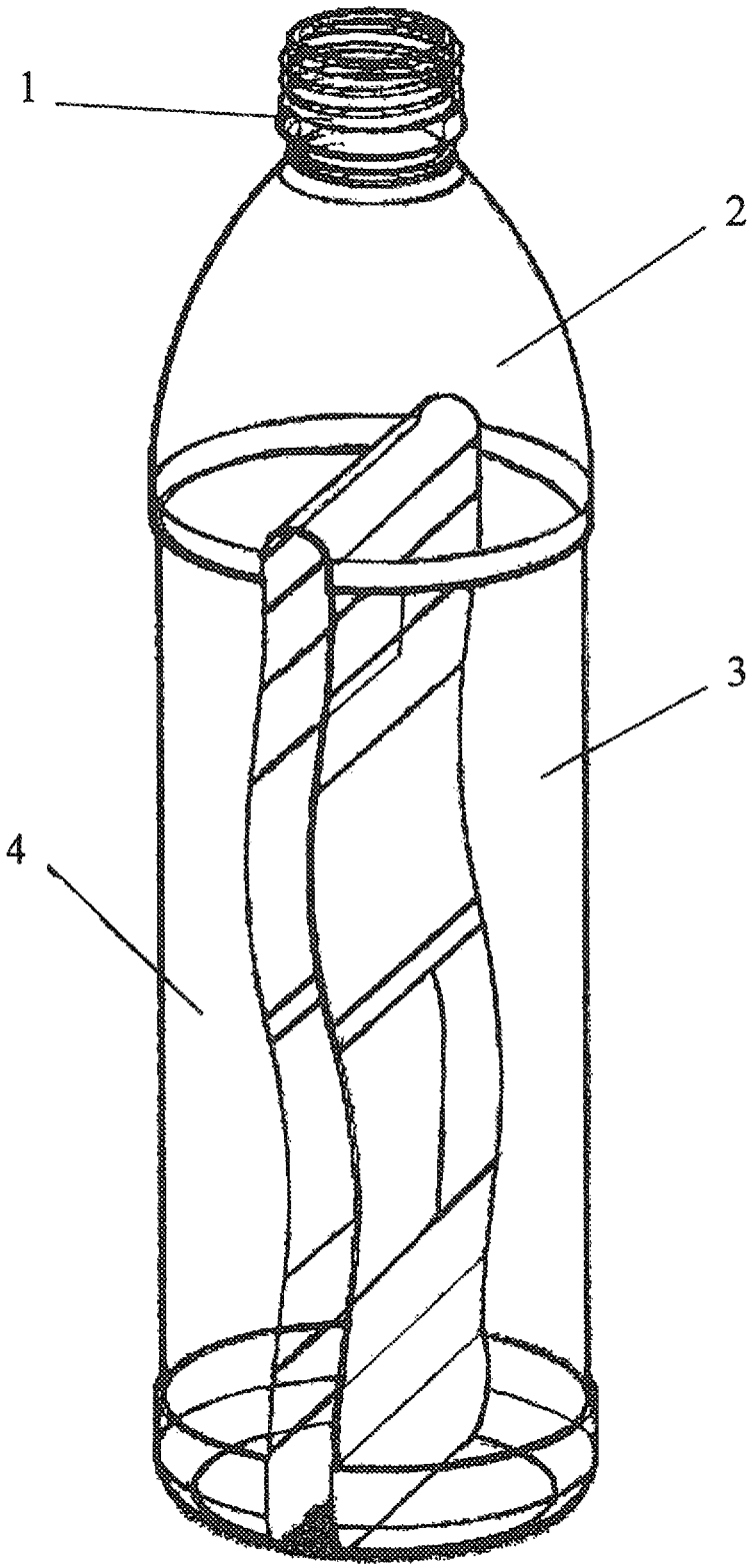
Figure 5:
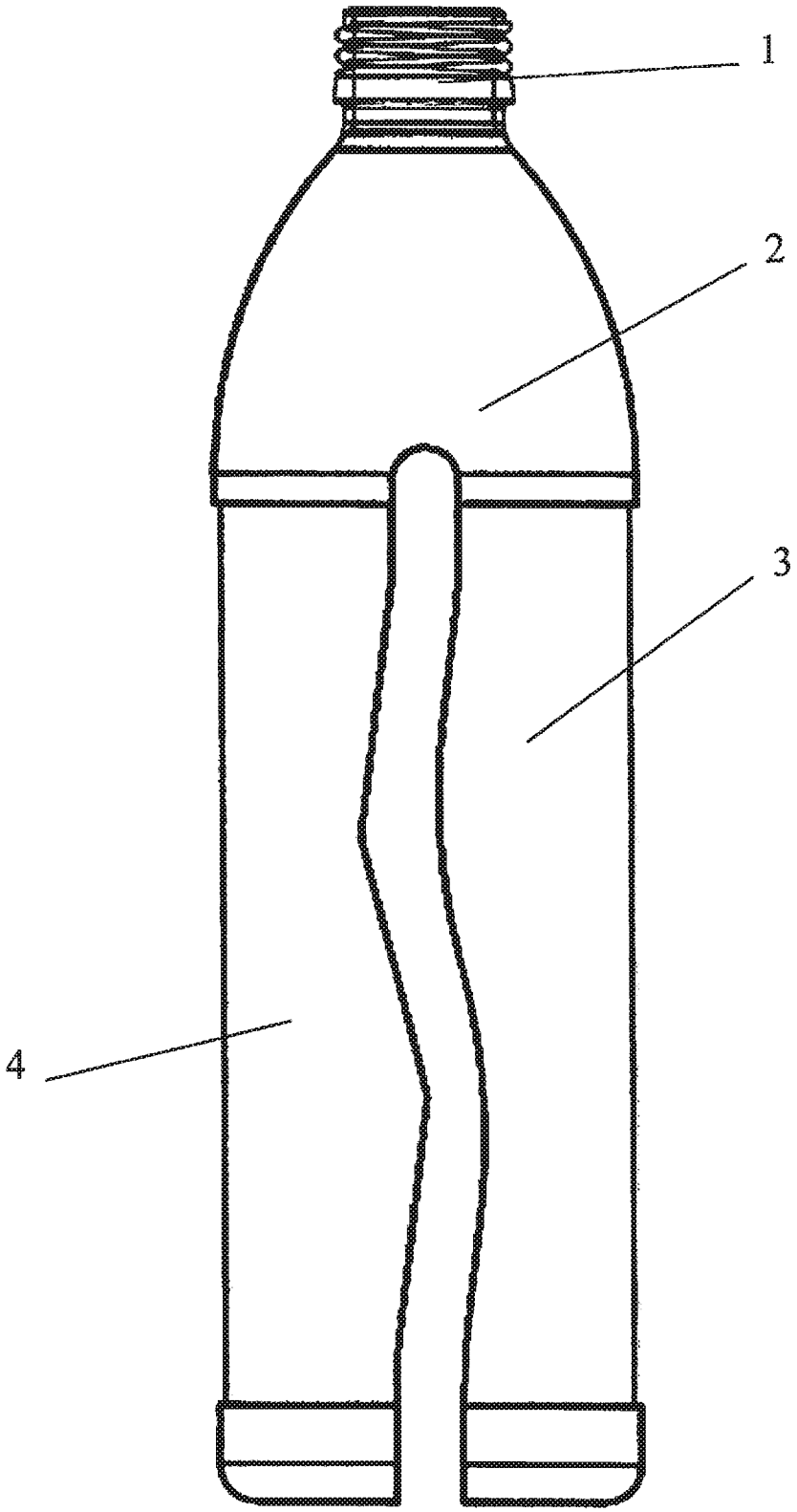
Figure 6:
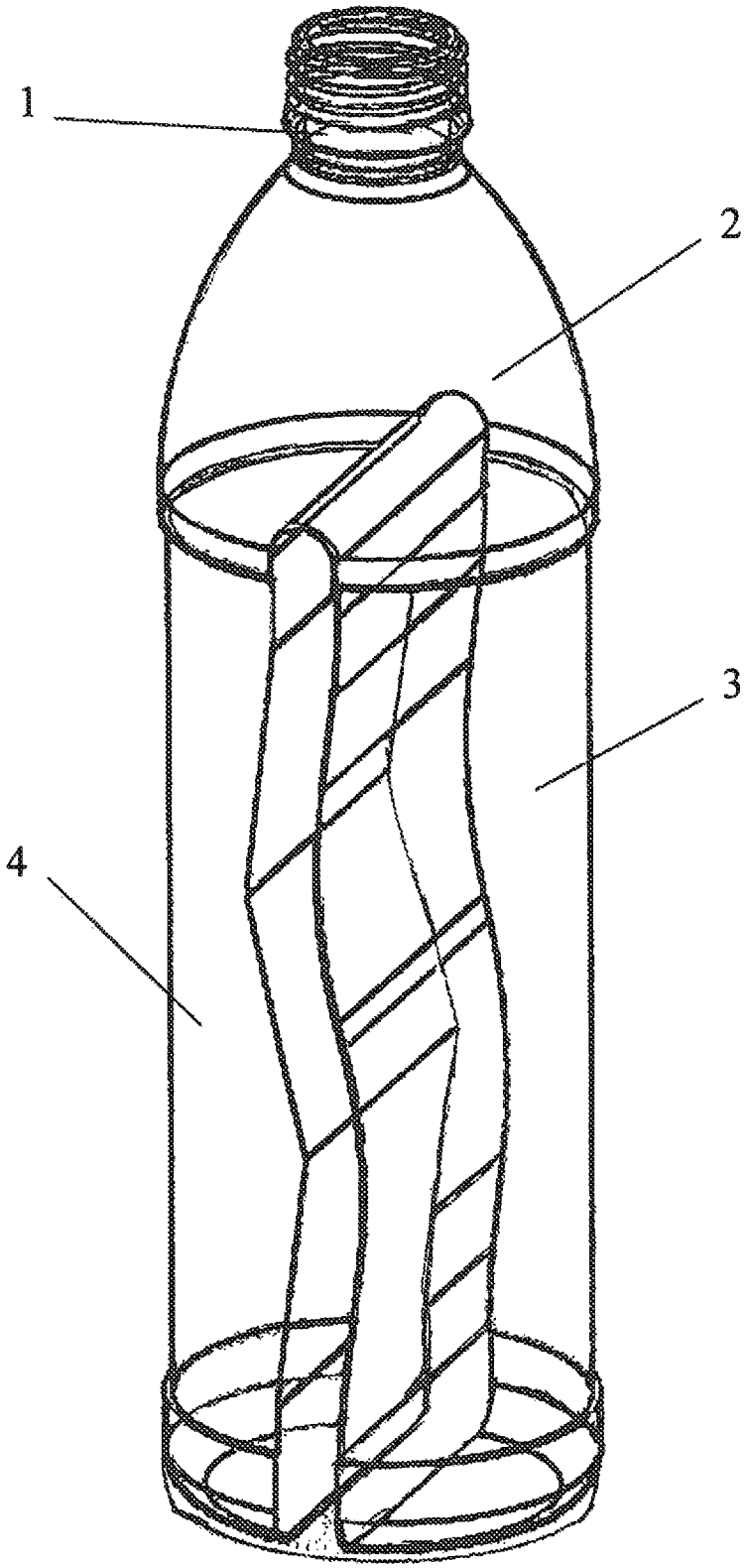
Figure 7:
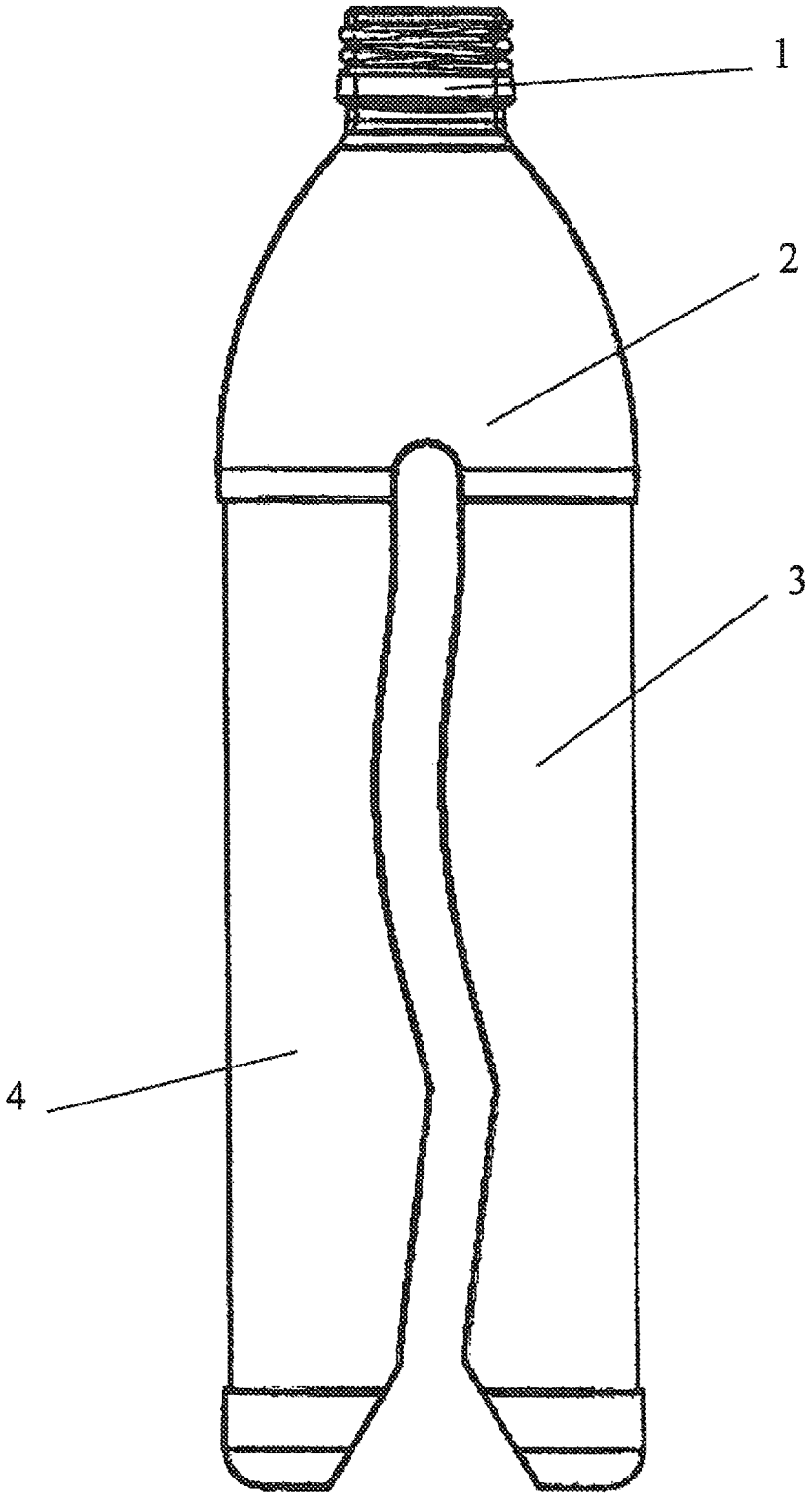

The invention is explained in drawings, where FIG. 1 shows a front view of the bottle, where the projections of the walls on the plane, which is perpendicular to the transverse axis of the groove, are in the form of zigzag-shaped lines, where each zigzag-shaped consist of sections of straight lines;

FIG. 2 presents a projection view as per FIG. 1;

FIG. 3 shows a front view of the bottle, where the projections of the walls on the plane, which is perpendicular to the transverse axis of the groove, are in the form of zigzag-shaped lines, where each zigzag-shaped consist of sections of curved lines;

FIG. 4 presents a projection view as per FIG. 3;

FIG. 5 shows a front view of the bottle, where the projections of the walls on the plane, which is perpendicular to the transverse axis of the groove, are in the form of zigzag-shaped lines, one of which consists of sections of curved lines, and the other one consists of sections of straight lines;

FIG. 6 presents a projection view as per FIG. 5;

FIG. 7 shows a front view of the bottle, where the projections of the walls on the plane, which is perpendicular to the transverse axis of the groove, are in the form of zigzag-shaped lines, which consist in part of sections of curved lines, and in part of sections of straight lines.

EVIDENCE OF FEASIBILITY OF INVENTION

The bottle comprises cylinder-shaped neck 1 with male thread and body 2 with a groove dividing the body into two parts 3 and 4.

The dimensions of the groove are determined experimentally. A larger depth of the groove would result in a lower rigidity of the bottle and a higher speed of its being filled with a liquid. A smaller depth of the groove would result in a lower reliability of attachment of the bottle.

The groove enables to arrange a part of the body of the bottle in a pocket of clothes, or in a pocket of a bag, or to arrange it on a door of a car, in a pocket at the back of the seat ahead in a vehicle.

It has been experimentally established that a 0.3 to 0.6 l bottle of the aforesaid design can be easily accommodated in pockets of most of clothing items. Below are presented the results of tests of a plastic bottle with a groove, the projections of which on the plane perpendicular to the transverse axis of the groove, are in the form of zigzag-shaped lines. Objective of tests: Assessment of change in friction force depending on the suggested configuration of the groove. The tests involve measuring the force of friction between the bottle of the known and proposed design, and the object of attachment.

The sample under testing is fixed on the clothing item "men's trousers" having a unified hip pocket, which is 120 to 160 mm deep.

The force required for removal of the bottle is measured with a dynamometer.

The results of tests of the plastic bottle samples are presented in the table below.

TABLE

Test results

| Measurement No. | Overall dimensions of sample (mm) | Sample under testing | Static friction force (N) |
|---|---|---|---|
| 1 | Height: 229.1 | Known sample with a | 5.5 |
| 2 | Diameter of base | straight groove | 6.0 |
| 3 | 66.0 | | 6.5 |
| 4 | | | 5.7 |
| 5 | | | 6.2 |
| 6 | | Proposed sample | 9.0 |
| 7 | | | 8.7 |
| 8 | | | 9.2 |
| 9 | | | 9.5 |
| 10 | | | 8.9 |

Therefore, it has been established that the proposed design of the plastic bottle enables to attach it more securely on bags, bagpacks and accessories.

The bottle described is user-friendly while being visually attractive for consumer.

The bottle described can be serially produced of plastic in conditions of commercial manufacture involving use of available equipment with application of state-of-art technologies.

The invention claimed is:

1. A plastic bottle comprising a hollow, thin-walled, generally cylindrical body ending with a neck, the bottle configured to be held upright via an open groove formed integrally in the bottle, said open groove being of essentially constant width and molded in the body; said open groove being oriented generally parallel to a central axis of the bottle, wherein said open groove extends for more than half the height of the bottle and follows a zigzag-shape path.

2. The plastic bottle of claim 1, wherein the zigzag-shape path consists of straight sections.

3. The plastic bottle of claim 1, wherein the zigzag-shape path consists of curved sections.

4. The plastic bottle of claim 1, wherein the zigzag-shape path consists of straight sections and curved sections.

5. The plastic bottle of claim 1, wherein the zigzag-shape path comprises a plurality of identical opposing surfaces.

6. The plastic bottle according to claim 1, wherein the open groove is located along the central axis of the bottle.

* * * * *